US006319091B1

(12) United States Patent
Kilbride et al.

(10) Patent No.: US 6,319,091 B1
(45) Date of Patent: Nov. 20, 2001

(54) BRASSIERE

(75) Inventors: Lynn Elizabeth Kilbride; Janette Kaye Cothrel, both of Noblesville, IN (US)

(73) Assignee: LifeWorks, L.L.C., Noblesville, IN (US)

( * ) Notice: Subject to any disclaimer, the term of this patent is extended or adjusted under 35 U.S.C. 154(b) by 0 days.

(21) Appl. No.: 09/460,448

(22) Filed: Dec. 13, 1999

(51) Int. Cl.[7] ..... A41C 3/00
(52) U.S. Cl. ..... 450/17; 450/1
(58) Field of Search ..... 450/1, 17, 18, 450/23, 25, 26, 28, 58, 62, 63, 64, 82, 86

(56) References Cited

U.S. PATENT DOCUMENTS

| | | | | |
|---|---|---|---|---|
| 1,400,056 | * | 12/1921 | Hadley | 450/58 |
| 2,753,563 | | 7/1956 | Blitch . | |
| 2,970,597 | * | 2/1961 | Michel | 450/58 |
| 3,302,649 | * | 2/1967 | Bruno | 450/58 |
| 4,325,378 | * | 4/1982 | Wilkinson | 450/58 |
| 4,804,351 | | 2/1989 | Raml et al. . | |
| 4,917,651 | * | 4/1990 | Rainville | 450/58 |
| 5,032,104 | | 7/1991 | Rainville . | |
| 5,152,741 | | 10/1992 | Farnio . | |
| 5,180,326 | | 1/1993 | Williams . | |
| 5,538,502 | | 7/1996 | Johnstone . | |

* cited by examiner

*Primary Examiner*—Gloria M. Hale
(74) *Attorney, Agent, or Firm*—Woodard, Emhardt, Naughton, Moriarty & McNett

(57) ABSTRACT

The present invention relates to a brassiere for disabled women not having the full use of both upper extremities, wherein the brassiere is adapted to be put on, removed, and adjusted by the wearer alone. In one form, the brassiere is front closing and includes a ring coupled to one front side and a tongue coupled to the other front side. The tongue is adapted to include spaced interlocking fasteners attached to its surface such that the tongue may be looped through the ring, folded onto itself with the fasteners aligned, and the fasteners locked together around the ring by a wearer having the decreased use of one or both arms.

6 Claims, 6 Drawing Sheets

20A
22A
24A
26A
28A
34A
36A
38A
40A
52A
54A
56A
57A
58A
60A
62A
35

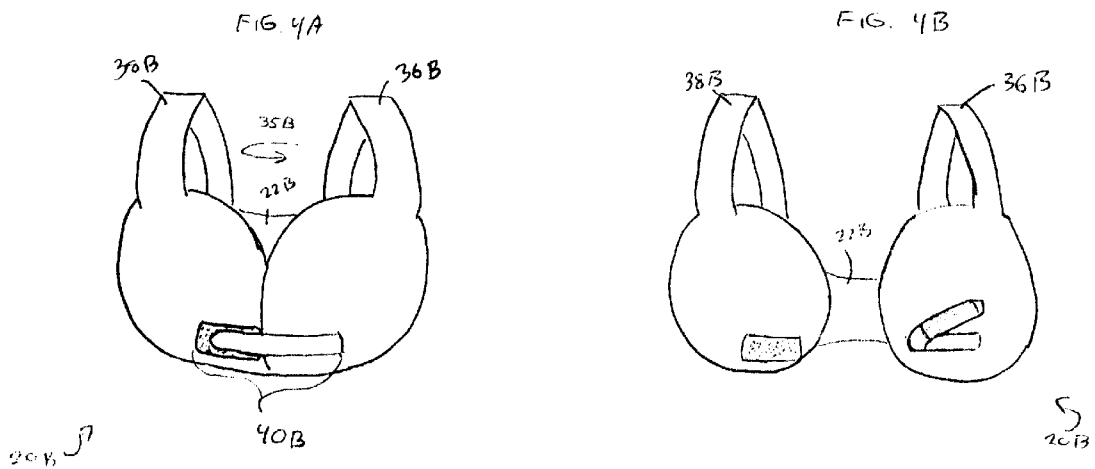
FIG. 4A
FIG. 4B
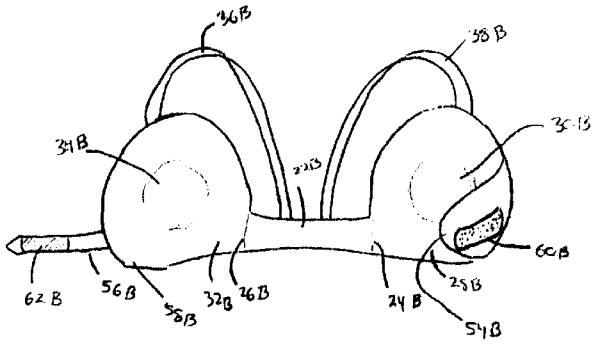
FIG 4C

BRASSIERE

TECHNICAL FIELD OF THE INVENTION

The present invention relates generally to brassieres and, more particularly, to a brassiere that may be put on and taken off by a person having a condition limiting the use of one or both upper extremities, such as a person suffering an amputation, a neurological deficit, or arthritis.

BACKGROUND OF THE INVENTION

For people without the full use of both upper extremities, such as those suffering from an amputation, paralysis, arthritis, neurological deficits, bone fractures or the like, the task of dressing can be quite difficult as well as very time consuming. Others, such as nursing mothers, athletes, and women whose jobs routinely or constantly occupy their extremities, may be required to remove or adjust their brassieres using only one hand. People without the full use of both upper extremities often have difficulty putting on and taking off garments, and this is particularly true of brassieres. Most brassieres close with fasteners such as hooks and eyes, buttons and buttonholes, zippers, and the like, requiring two hands to readily pull them together during fastening and unfastening and making putting on, removing and adjusting a brassiere very difficult for someone without the full use of both upper extremities. Even brassieres employing hook and loop (VELCRO) fasteners, such as the front-closing brassieres described in U.S. Pat. Nos. 5,538,502 and 5,032,104, require both hands to simultaneously pull together both sides of the brassiere during fastening. Moreover, even after the brassiere is put on adjustments to the fit may still be necessary during the course of wear, necessitating unhooking, rehooking or making other adjustments that are again very difficult for someone having the use of only one upper extremity or having decreased use of both upper extremities.

Even for those lucky enough to have available someone to assist them, it can still be embarrassing, uncomfortable, and awkward to have to ask for help with such an intimate task as putting on underwear. Moreover, even if some assistance is available, that assistance may not be continuously available throughout the course of wear of the brassiere. Further, in addition to the obvious physical disadvantages of requiring assistance to get dressed and undressed, there is also a psychological disadvantage arising from the decreased degree of independence inherent in not being able to put on one's own underwear. Most people prefer to be as independent as possible regarding self-care. Personal independence is important not only from a standpoint of reducing the need for expensive home health care aid (either from professional services or from family members donating valuable time and other resources) but from a perspective of maintaining a sense of dignity and self-worth. For those people not having the full use of both upper extremities, any increase in personal independence is an opportunity for relieving some of the financial, physiological, and psychological burdens imposed upon them by their condition.

There is therefore a need for a brassiere that may be readily put on, taken off and adjusted independently by a person not enjoying the full use of both upper extremities. The present invention is directed toward meeting this need.

SUMMARY OF THE INVENTION

The present invention relates generally to the field of brassieres. One embodiment of the present invention relates to a brassiere fastening with a tongue having spaced arrays of both hook-type and loop-type nylon fasteners attached thereto and extending from one end of the brassiere, passing through a ring coupled to the other end of the brassiere, and looping back onto itself such that the hooktype fasteners releasably lockingly engage the loop-type fasteners.

One object of the present invention is to provide an improved brassiere. Related objects and advantages of the present invention will be apparent from the following description

DETAILED DESCRIPTION OF THE PREFERRED EMBODIMENT

Figure 1B:
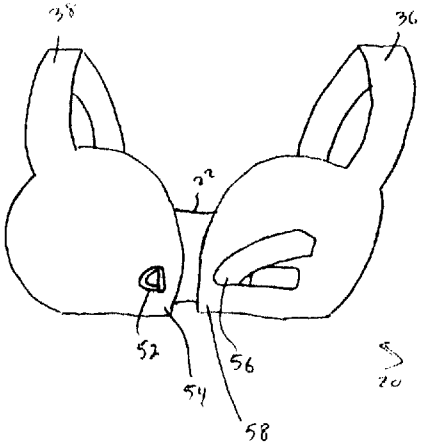
FIG. 1B is a front perspective view of the embodiment of FIG. 1A unfastened.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1C:
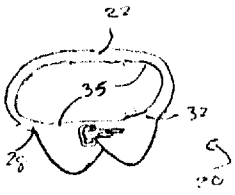
FIG. 1C is a bottom schematic view of FIG. 1A
Figure 1A:
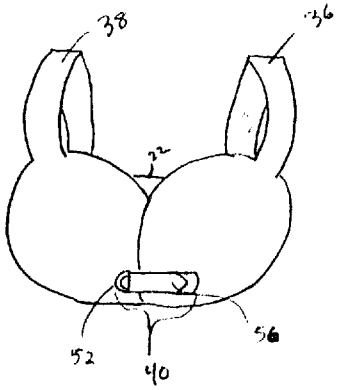
FIG. 1A is a front perspective view of a fastened front opening brassiere of a first embodiment of the present invention.

FIGS. 1A–1C illustrate a first embodiment of the present invention, an improved brassiere 20 adapted to be put on and taken off by a person having the use of only one hand. Brassiere 20 is formed from an open ring of flexible material. Preferably, the brassiere is made from spandex and/or cotton, but any convenient flexible material may be chosen. Brassiere 20 may include underwiring for additional support if desired. Brassiere 20 includes a backstrap portion 22 having a first backstrap end 24 and a second backstrap end 26. Preferably, backstrap portion 22 is made from a material having some degree of elasticity, such as spandex. Brassiere 20 further includes a first front band portion 28 having a first breast cup 30 formed therein and a second front band portion 32 having a second breast cup 34 formed therein. First cupped front band portion 28 is connected to first backstrap end 24 and second cupped front band portion 32 is connected to second backstrap end 26, which may be connected to first backstrap end 24, thereby forming a continuous torso-encircling band 35 having a first cupped end portion 28 and a second cupped end portion 32. Backstrap 22 and front band portions 28, 32 may be formed from a single piece of flexible material, or may be formed from separate pieces of flexible material and attached together. Brassiere 20 further includes a first and second flexible shoulder strap 36, 38 extending respectively from first and second cups 30, 34 to backstrap portion 22.

Figure 2:
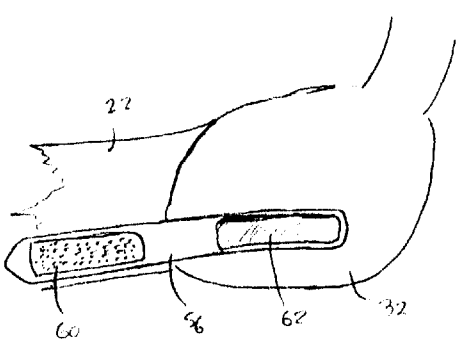
FIG. 2 is a partial enlarged front perspective view of a fastening tongue of the embodiment of FIG. 1A.
Figure 1D:
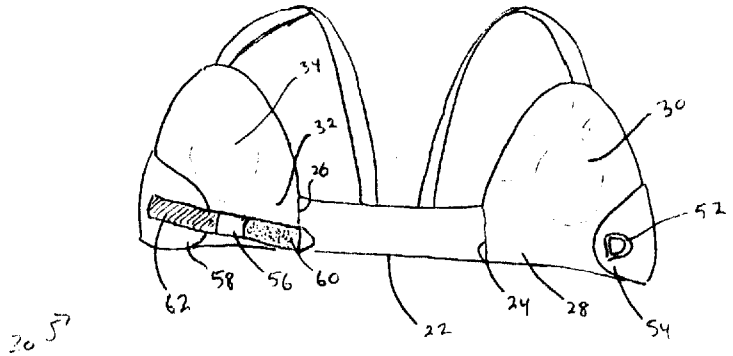
FIG. 1D is a rear perspective view of the embodiment of FIG. 1A unfastened.

Brassiere 20 further includes connection means 40 for single-handedly releasably and adjustably coupling the first cupped end portion 28 and the second cupped end portion 32. In this embodiment, connection means 40 includes a ring member 52 and a flexible elongated member or tongue 56. Ring member 52 is coupled to first front band 28 at a first front band end 54. Tongue 56 is coupled to and extends from a second front band end 58. As shown in detail in FIG. 2, tongue 56 further includes a first tongue connector portion 60 and a second tongue connector portion 62 adapted to releasably lockingly engage first connector portion 60. Tongue connector portions 60, 62 are spaced apart from one another on the same side of tongue 56. Tongue 56 is sized to readily pass through ring member 52, and is of sufficient length such that tongue 56 may pass through and loopingly engage ring member 52, such that connector portion 60 may extend at least partially through ring member 52 when first and second front band ends 54, 58 are brought together. Tongue 56 may be looped through ring member 52, pulled until the desired fit is attained, and fastened in place by lockingly engaging connector portions 60 and 62. Likewise, the fit of brassiere 20 may be adjusted by disengaging connector portions 60 and 62, tightening or loosening tongue 56 as desired, and re-engaging connectors 60, 62.

Ring member 52 is preferably made of a rigid material such as steel, aluminum or plastic and preferably has a D-shape, although ring member 52 may have any convenient ring-shape and may be made of any convenient sufficiently rigid material. Connector portions 60 and 62 are preferentially arrays of releasably interlockable hooks and loops, respectively (such as VELCRO), but may together be any convenient fastener pair, such as hook and eye, hook and latch, or button and buttonhole. In a preferred embodiment, first connector portion 60 may be either an array of hooks or an array of loops while second connector portion 62 may be a corresponding array of loops or an array of hooks; which is which is unimportant, as long as there are both an array of hooks and a corresponding array of loops.

Figures 3A, 3B, 3C:
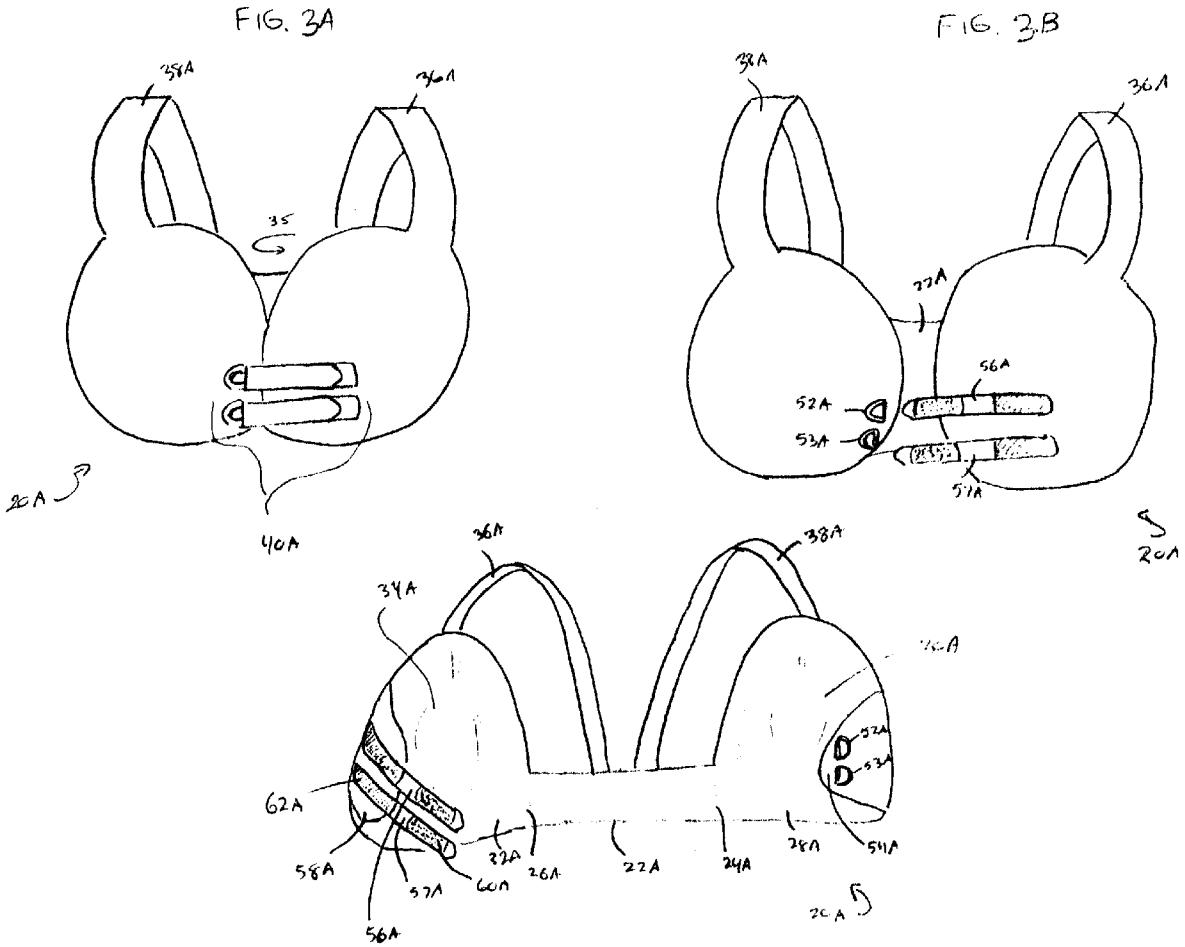
FIG. 3A is a front perspective view of a fastened front opening brassiere of a second embodiment of the present invention.
FIG. 3B is a front perspective view of the embodiment of FIG. 3A unfastened.

FIGS. 3A–C illustrate a second embodiment of the present invention, a front opening brassiere 20A having a flexible backstrap portion 22A with a first backstrap end 24A and a second backstrap end 26A, wherein first backstrap end 24A is connected to a first front band portion 28A having a first breast cup 30A formed therein and second backstrap end 26A is connected to a second front band portion 32A having a second breast cup 34A formed therein. First cupped front band portion 28A is connected to first backstrap end 24A and second cupped front band portion 32A is connected to second backstrap end 26A which may be connected to first backstrap end 24A, thereby forming a continuous torso-encircling band 35A having a first cupped end portion 28A and a second cupped end portion 32A. Brassiere 20A further includes a first and second flexible shoulder strap 36A, 38A extending respectively from the first and second cups 30A, 34A to the backstrap portion 22A.

Brassiere 20A further includes connection means 40A for single-handedly releasably and adjustably coupling the first cupped end portion 28A and the second cupped end portion 32A. In this embodiment, connection means 40A includes a pair of ring members 52A and 53A and a pair of tongues 56A and 57A. First front band 28A includes a pair of ring members 52A and 53A coupled to a first front band end 54A. Second front band 32A includes a pair of tongues 56A and 57A coupled to and extending from a second front band end 58A. Tongues 56A and 57A each include a first tongue connector portion 60A and a second tongue connector portion 62A. Tongue connector portions 60A, 62A are spaced apart from one another on the same side of tongues 56A and 57A. Each tongue 56A, 57A is sized to readily pass through a respective ring member 52A, 53A and is of sufficient length such that respective connector portion 60A may extend at least partially through respective ring member 52A, 53A when first and second front band ends 54A, 58A are brought together. Ring members 52A and 53A are preferably made of a rigid material such as steel, aluminum, or plastic and preferably has a D-shape, although ring members 52A, 53A may have any convenient ring-shape and may be made of any convenient material. Connector portions 60A and 62A are preferentially arrays of releasably interlockable hooks and loops, respectively (such as VELCRO) but may be together be any convenient fastener pair, such as hook and eye, hook and latch, or button and buttonhole. In a preferred embodiment, first connector portion 60A may be either an array of hooks or an array of loops while second connector portion 62A may be a corresponding array of loops or an array of hooks; which is which is unimportant as long as there is both an array of hooks and a corresponding array of loops.

Figure 4A:
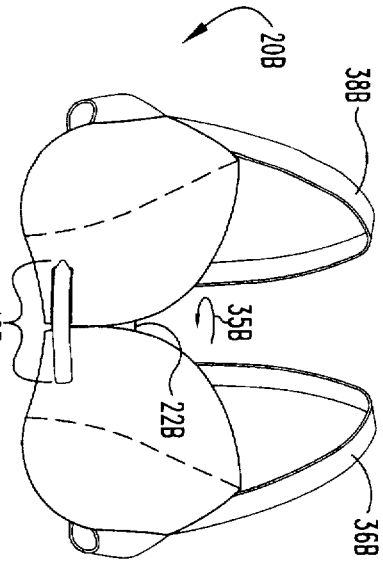
FIG. 4A is a front perspective view of a fastened front opening brassiere of a third embodiment of the present invention.
Figure 4B:
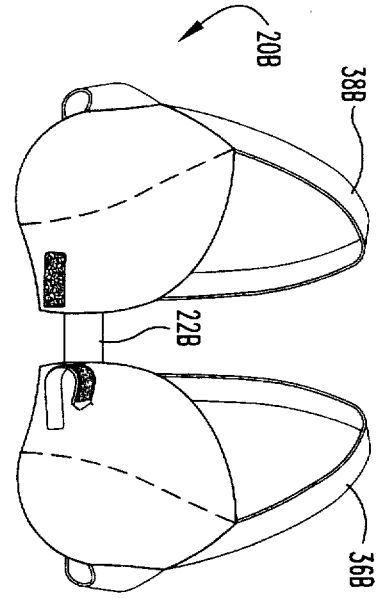
FIG. 4B is a front perspective view of the embodiment of FIG. 4A unfastened.
Figure 4C:
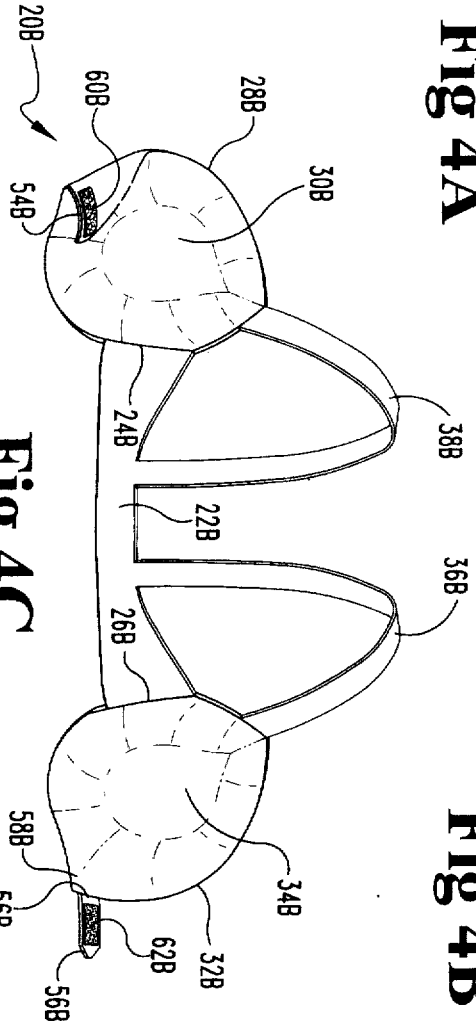
FIG. 4C is a rear perspective view of the embodiment of FIG. 4A.
Figure 5A:
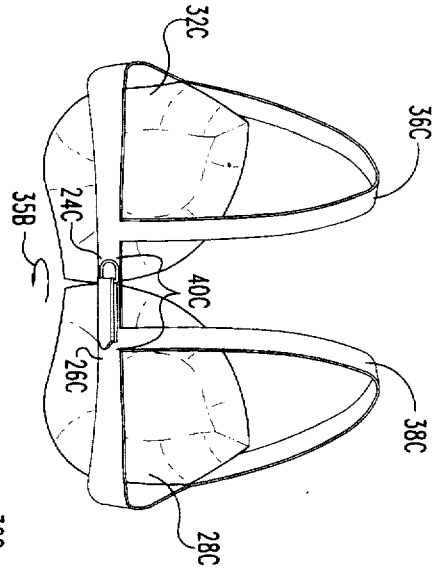
Figure 5B:
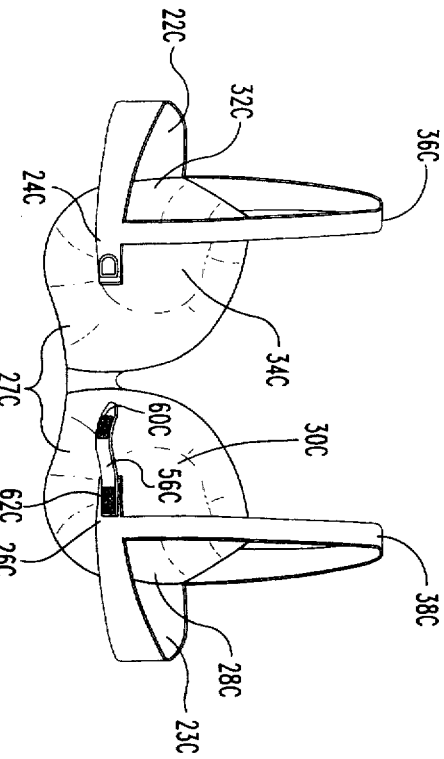
Figure 5C:
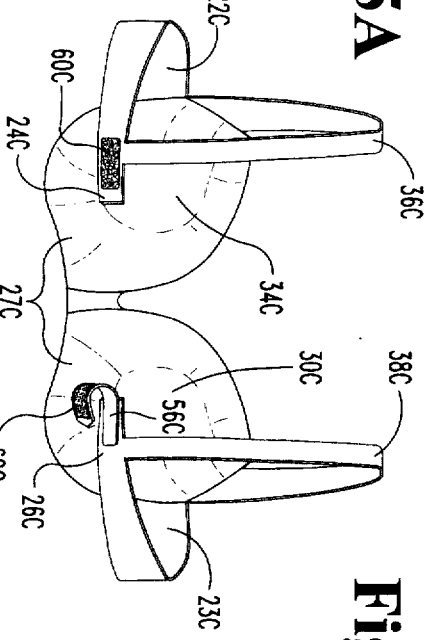
Figure 7A:
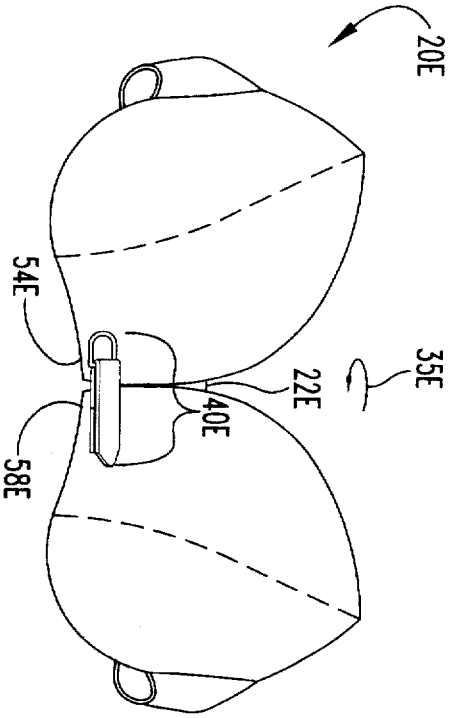
Figure 7B:
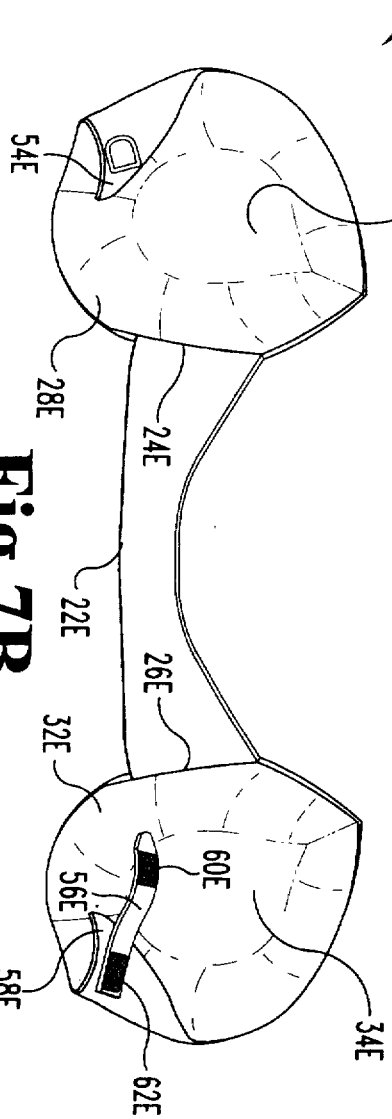

FIGS. 4A–C illustrate a third embodiment of the present invention, a frontopening brassiere 20B having a flexible backstrap portion 22B with a first backstrap end 24B and a second backstrap end 26B, wherein first backstrap end 24B is connected to a first front band portion 28B having a first breast cup 30B formed therein and second backstrap end 26B is connected to a second front band portion 32B having a second breast cup 34B formed therein. First cupped front band portion 28B is connected to first backstrap end 24B and second cupped front band portion 32B is connected to second backstrap end 26B which may be connected to first backstrap end 24B, thereby forming a continuous torso-encircling band 35B having a first cupped end portion 28B and a second cupped end portion 32B. Brassiere 20B further includes a first and second flexible shoulder strap 36B, 38B extending respectively from first and second cups 30B, 34B to backstrap portion 22B.

Brassiere 20B further includes connection means 40B for single-handedly releasable and adjustably coupling first cupped end portion 28B and second cupped end portion 32B. In this embodiment, connection means 40B includes a first connector portion 60B attached to first cupped end portion 28B and an elongated tongue 56B attached to and extending from second cupped end portion 32B. Elongated tongue 56B includes a second connector portion 62B formed thereon. Tongue 56B has sufficient length such that connector portions 60B and 62B may substantially overlap when first and second front band ends 54B, 58B are brought together, such that brassiere 20B may be both fastened and adjusted using only one hand. Connector portions 60B and 62B are preferentially respective elongated arrays of releasably interlockable hooks and loops (such as VELCRO) but may together be any convenient fastener pair, such as hook and eye, hook and latch, or button and buttonhole. In a preferred embodiment, first connector portion 60B may be either an array of hooks or an array of loops while second connector portion 62B may be a corresponding array of loops or an array of hooks; which is which is unimportant as long as there is both an array of hooks and a corresponding array of loops.

Figure 5A:
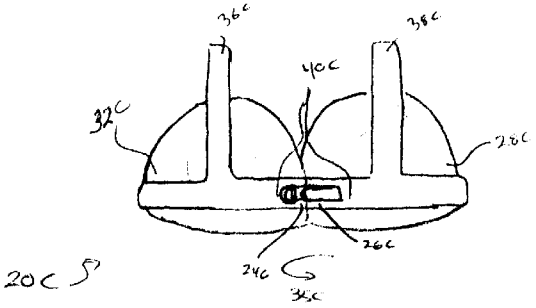
FIG. 5A is a rear view of a fastened rear-opening brassiere of a fourth embodiment of the present invention.
Figure 5B:
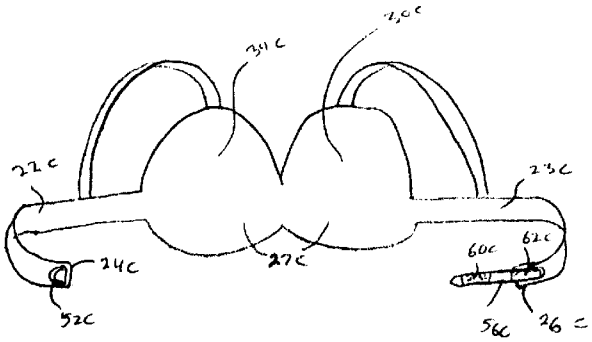
FIG. 5B is a rear perspective view of the embodiment of FIG. 5A unfastened.

FIGS. 5A–B show a fourth embodiment of the present invention, a back opening brassiere 20C having a flexible front band portion 27C having a first breast cup 30C and a second breast cup 34C formed therein. Brassiere 20C further includes a first flexible backstrap portion 22C with a first backstrap end 24C and a second flexible backstrap portion 23C with a second backstrap end 26C respectively extending from either end of flexible front band portion 27C. Front band portion 27C with first backstrap portion 22C and second backstrap portion 23C extending from either end may, when backstrap ends 24C, 26C are connected together, form a continuous torso-encircling band 35C having a first cupped end portion 28C and a second cupped end portion 32C. Brassiere 20C further includes a first and second flexible shoulder strap 36C, 38C extending respectively from the first and second cups 30C, 34C to backstrap portions 23C, 24C.

Brassiere 20C further includes connection means 40C for single-handedly releasably and adjustably coupling the first cupped end portion 28C and the second cupped end portion 32C. In this embodiment, connection means 40C includes a ring member 52C and a tongue 56C. First flexible backstrap portion 22C includes ring member 52C coupled to a first backstrap end 24C. Second flexible backstrap portion 23C includes a tongue 56C coupled to and extending from second backstrap end 26C. Tongue 56C includes a first tongue connector portion 60C and a second tongue connector portion 62C. Tongue connector portions 60C, 62C are spaced apart from one another on the same side of tongue 56C. Tongue 56C is sized to readily pass through ring member 52C and is of sufficient length such that respective connector portion 60C may extend at least partially through ring member 52C when first and second backstrap ends 24C, 26C are brought together. Ring member 52C is preferably made of a rigid material such as steel, aluminum or plastic and preferably has a D-shape, although ring member 52C may have any convenient ring-shape and may be made of any convenient material. Connector portions 60C and 62C are preferentially respective arrays of releasably interlockable hooks and loops (such as VELCRO) but may together be any convenient fastener pair, such as hook and eye, hook and latch, or button and buttonhole. In a preferred embodiment, first connector portion 60C may be either an array of hooks or an array of loops while second connector portion 62C may be a corresponding array of loops or an array of hooks; which is which is unimportant as long as there is both an array of hooks and a corresponding array of loops. Brassiere 20C may be fastened by overlapping first and second connector portions 60C, 62C, and pressing connector portions 60C, 62C together. Brassiere 20C may be single-handedly adjusted by partially disengaging connector portions 60C, 62C and tightening/loosening brassiere 20C by adjusting the distance between backstrap ends 24C and 26C and then re-engaging connector portions 60C and 62C. This adjustment process may be repeated until the desired fit is attained. Such fastening and adjusting operations may be performed while brassiere 20 is positioned as worn (cupping the breasts) or, more preferably, while brassiere is rotated about 180 degrees about the torso with the first and second backstrap ends 24C, 26C are oriented in front of the wearer.

Figure 5C:
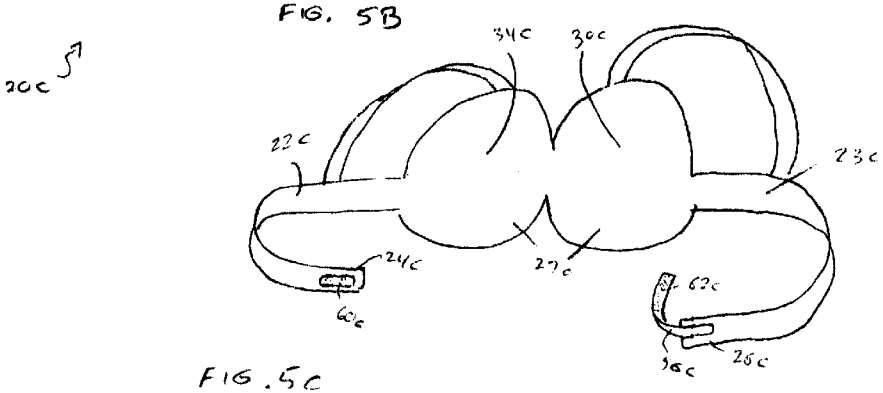
FIG. 5C is a rear perspective view of an alternate fourth embodiment rearopening brassiere.

FIG. 5C illustrates and alternate embodiment of a rear-opening brassier 20, having a first connector portion 60C attached to first backstrap end 24C and an elongated tongue 56C attached to and extending from second backstrap end 26C. Elongated tongue 56C includes a second connector portion 62C formed thereon. Tongue 56C has sufficient length such that connector portions 60C and 62C may substantially overlap when first and second backstrap 24C, 26C are brought together, such that brassiere 20C may be both fastened and adjusted using only one hand. Such fastening operations may be performed while brassiere 20 is positioned as worn (cupping the breasts) or, more preferably, while brassiere is rotated about 180 degrees about the torso with the first and second backstrap ends 24C, 26C are oriented in front of the wearer. Connector portions 60C and 62C are preferentially respective elongated arrays of releasably interlockable hooks and loops (such as VELCRO) but may together be any convenient fastener pair, such as hook and eye, hook and latch, or button and buttonhole. In a preferred embodiment, first connector portion 60B may be either an array of hooks or an array of loops while second connector portion 62B may be a corresponding array of loops or an array of hooks; which is which is unimportant as long as there is both an array of hooks and a corresponding array of loops.

Figures 6A, 6B, 6C:
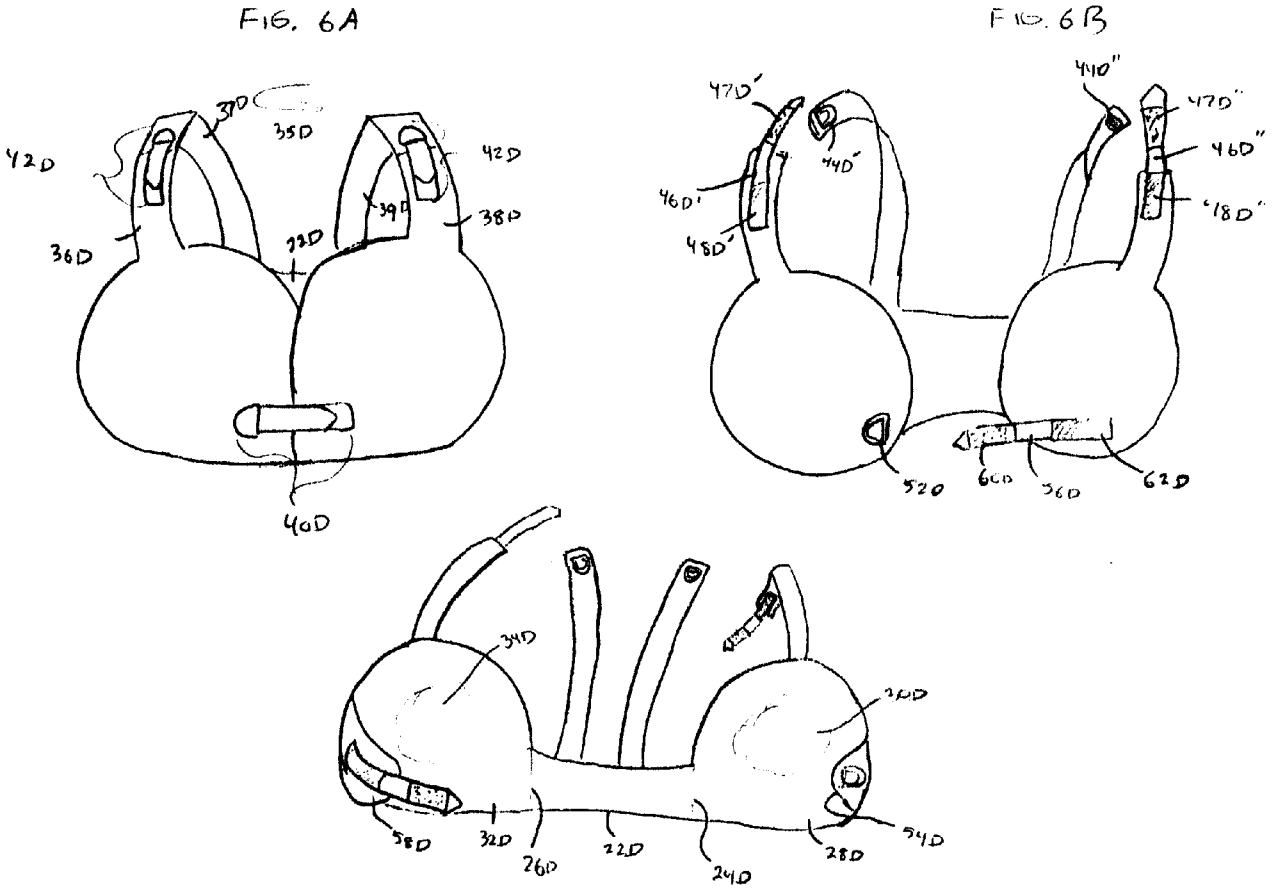
FIG. 6A is a front perspective view of a fastened front opening brassiere of a fifth embodiment of the present invention.
FIG. 6B is a front perspective view of the embodiment of FIG. 6A unfastened.
FIG. 6C is a rear perspective view of the embodiment of FIG. 6A unfastened.

FIGS. 6A–C illustrate a fifth embodiment of the present invention, a front closing brassiere 20D adapted to be put on and taken off by a person having the use of only one hand and having single-handedly fastenable and adjustable shoulder straps 36D, 38D. Brassiere 20D includes a flexible backstrap portion 22D with a first backstrap end 24D and a second backstrap end 26D, wherein first backstrap end 24 is connected to a first front band portion 28D having a first breast cup 30D formed therein and second backstrap end 26D is connected to a second front band portion 32D having a second breast cup 34D formed therein. First cupped front band portion 28D is connected to first backstrap end 24D and second cupped front band portion 32D is connected to second backstrap end 26D which may be connected to first backstrap end 24D, thereby forming a continuous torso-encircling band 35D having a first cupped end portion 28D and a second cupped end portion 32D. Brassiere 20D further includes a first and second flexible front shoulder strap portion 36D, 38D extending from first and second cups 30D, 34D and a first and second rear shoulder strap portion 37D, 39D extending from backstrap portion 22D respectively towards first and second front shoulder strap portions 36D, 38D.

Brassiere 20D further includes connection means 40D for single-handedly releasably and adjustably coupling first cupped end portion 28D and the second cupped end portion 32D. In this embodiment, connection means 40D includes a ring member 52D and a tongue 56D. Ring member 52D is coupled to a first front band 28D at a first front band end 54D. Tongue 56D is coupled to and extends from a second front band end 58D. Tongue 56D further includes a first tongue connector portion 60D and a second tongue connector portion 62D. Tongue connector portions 60D, 62D are spaced apart from one another on the same side of tongue 56D. Tongue 56D is sized to readily pass through ring member 52D, and is of sufficient length such that connector portion 60D may extend at least partially through ring member 52D when first and second front band ends 54D, 58D are brought together.

Brassiere 20D also includes connection means 42D for single-handedly releasable and adjustably coupling respective first and second front and rear shoulder strap portions 36D, 37D, 38D, 39D. In this embodiment, connection means 42D includes a first and a second rear strap connector portion 44D', 44D" and first and second front strap connector portions 46D', 46D" adapted to releasably lockingly engage one another. Preferably, rear strap connector portions 44D', 44D"are ring members and front strap connector portions 46D', 46D" are tongues, but connector portions 44D', 44D", 46D', 46D" may be of any convenient connector design. Ring members 44D', 44D" are coupled to respective first and second front strap portions 36D, 38D. Tongues 46D', 46D" are respectively coupled to and extend from rear strap portions 37D, 39D. Each tongue 46D', 44D" further includes a respective first and second tongue first connector portion 47D', 47D" and a respective first and second tongue second connector portion 48D', 48D". Respective first tongue connector portions 47D'and 48D'and respective second tongue connector portions 47D" and 48D" are spaced apart from one another on the same side of respective tongues 46D', 46D". Tongues 46D', 46D" are sized to readily pass through ring members 44D', 44D" and are of sufficient length such that respective connector portions 47D', 47D" may extend at least partially through respective ring members 44D', 44D" when front strap portions 36D, 38D and respective rear strap portions 37D, 39D and are brought together.

Ring members 44D', 44D", 52D are preferably made of a rigid material such as steel, aluminum, or plastic and preferably has a D-shape, although ring member may have any convenient ring-shape and may be made of any convenient material. Connector portions 60D and 62D (and 47D', 47D", 48D'and 48D") are preferentially arrays of releasably interlockable hooks and loops, respectively (such as VELCRO) but may be together be any convenient fastener pair, such as hook and eye, hook and latch, or button and buttonhole. In a preferred embodiment, first connector portion 60D may be either an array of hooks or an array of loops while second connector portion 62D may be a corresponding array of loops or an array of hooks; which is which is unimportant as long as there is both an array of hooks and a corresponding array of loops.

Figure 7A:
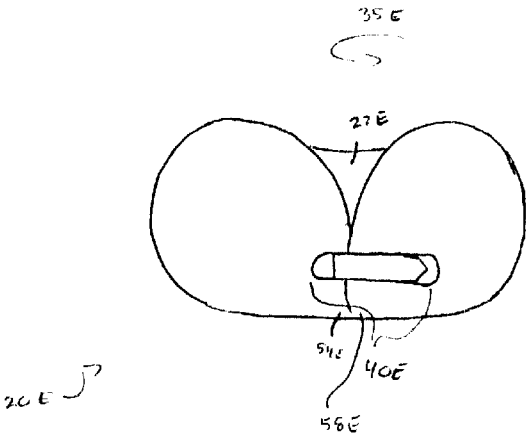
FIG. 7A is a front perspective view of a strapless fastened front opening brassiere of a sixth embodiment of the present invention.
Figure 7B:
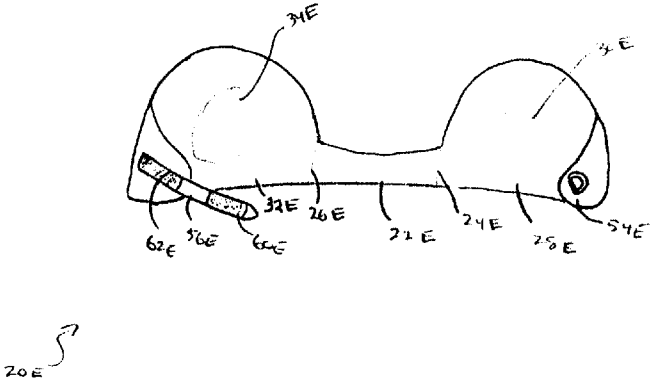
FIG. 7B is a rear perspective view of the embodiment of FIG. 7A.
Figure 1A:
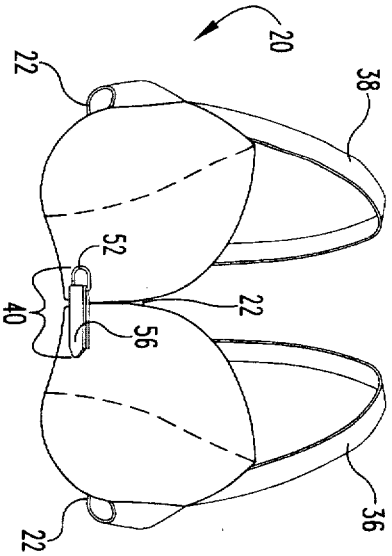
Figure 1B:
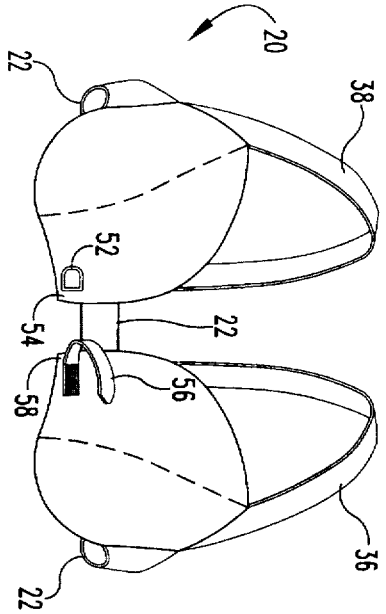
Figure 1C:
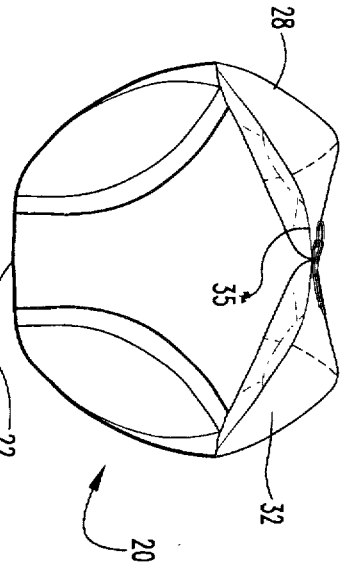
Figure 1D:
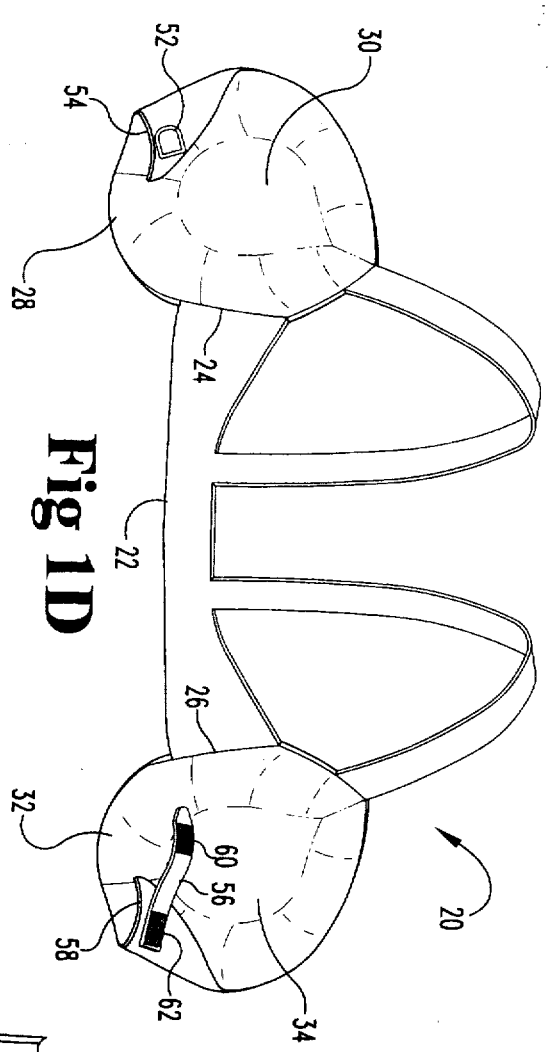
Figure 2:
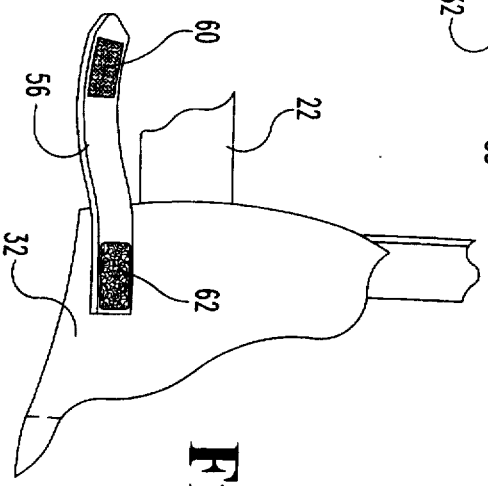
Figure 3A:
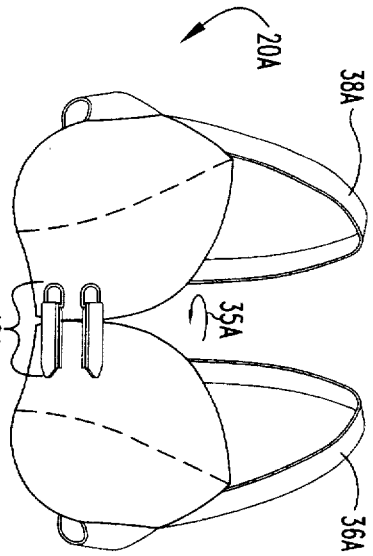
Figure 3B:
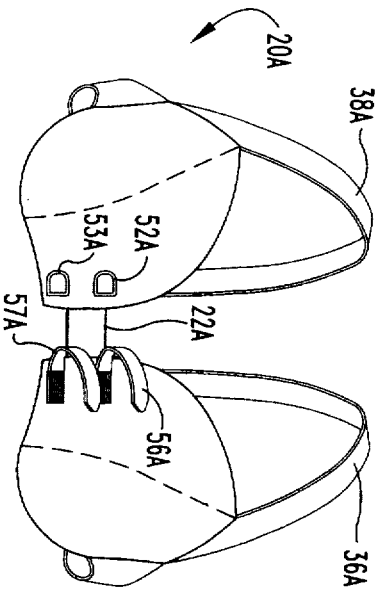
Figure 3C:
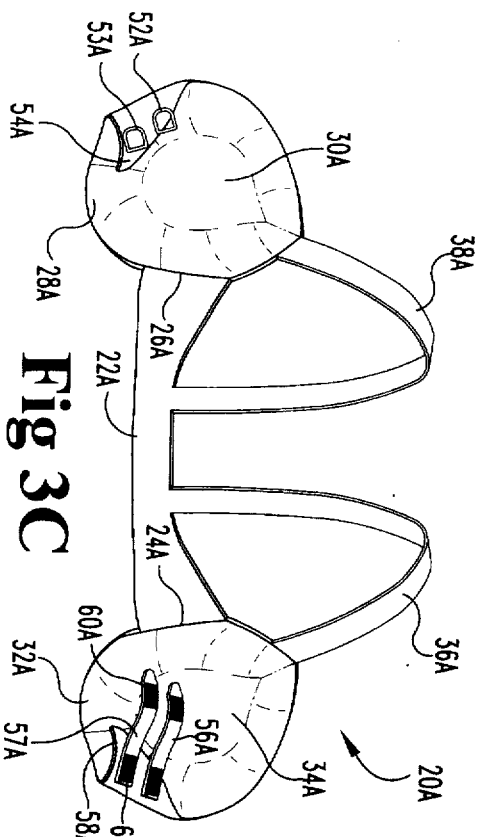

FIGS. 7A–B illustrate a sixth embodiment of the present invention, a strapless front opening brassiere 20E adapted to be put on and taken off by a person having the use of only one hand. Brassiere 20E includes a flexible backstrap portion 22E with a first backstrap end 24E and a second backstrap end 26E, wherein first backstrap end 24E is connected to a first front band portion 28E having a first breast cup 30E formed therein and second backstrap end 26E is connected to a second front band portion 32E having a second breast cup 34E formed therein. First cupped front band portion 28E is connected to first backstrap end 24E and second cupped front band portion 32E is connected to second backstrap end 26E which may be connected to first backstrap end 24E, thereby forming a continuous torso-encircling band 35E having a first cupped end portion 28E and a second cupped end portion 32E.

Brassiere 20E further includes connection means 40E for single-handedly releasable and adjustably coupling the first cupped end portion 28E and the second cupped end portion 32E. In this embodiment, connection means 40E includes a ring member 52E and a tongue 56E. Ring member 52E is coupled to a first front band 28E at a first front band end 54E. Tongue 56E is coupled to and extends from a second front band end 58E. Tongue 56E further includes a first tongue connector portion 60E and a second tongue connector portion 62E. Tongue connector portions 60E, 62E are spaced apart from one another on the same side of tongue 56E. Tongue 56E is sized to readily pass through ring member 52E, and is of sufficient length such that connector portion 60E may extend at least partially through ring member 56E when first and second front band ends 54E, 58E are brought together.

Ring member 52E is preferably made of a rigid material such as steel, aluminum, or plastic and preferably has a D-shape, although ring member may have any convenient ring-shape and may be made of any convenient material. Connector portions 60E and 62E are preferentially arrays of releasably interlockable hooks and loops, respectively (such as VELCRO) but may be together be any convenient fastener pair, such as hook and eye, hook and latch, or button and buttonhole. In a preferred embodiment, first connector portion 60E may be either an array of hooks or an array of loops while second connector portion 62E may be a corresponding array of loops or an array of hooks; which is which is unimportant as long as there is both an array of hooks and a corresponding array of loops.

In use, a wearer first encircles brassiere 20 around her torso. The wearer is presumed to have at least one breast. The wearer next inserts her breast(s) into the appropriate cup(s). The wearer then guides tongue 56 through ring member 52. Next, the wearer pulls tongue 56 over ring member 52 and back towards the portion of the brassiere 20 tongue 56 is connected to, pulling tongue 56 until brassiere 20 is snug around wearer's torso. In other words, the wearer guides tongue 56 through ring member 52 and then folds or loops tongue 56 back onto itself, tightening the fit of brassiere 20. The wearer then aligns connector portions 60 and 62 of tongue 56 with one another and lockingly engages connector members 60, 62. For hook and loop (VELCRO) connector means 40, locking engagement is accomplished by pressing connector portions 60 and 62 together. Brassiere is disengaged by gripping tongue 56 and pulling connector portion 62 out and away from connector portion 60. Tongue 56 may then be guided back through and away from ring member 52, completing disengagement, or may be guided slightly through ring member 52 to adjust the fit of brassiere 20.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. A brassiere comprising:

a flexible backstrap adapted to extend across a wearer's back and having a first backstrap end and a second backstrap end;

a first flexible front band portion having a first breast cup formed therein and adapted to extend from the first backstrap end around a wearer's torso and partially across a wearer's chest;

a second flexible front band portion having a second breast cup formed therein and adapted to extend from the second backstrap end around a wearer's torso and partially across a wearer's chest;

a first flexible shoulder strap adapted to extend from the flexible backstrap over a wearer's shoulder to the first flexible front band portion;

a second flexible shoulder strap adapted to extend from the flexible backstrap over a wearer's shoulder to the second flexible front band portion;

an first elongated tongue connected to the first flexible front band portion and having a first tongue first connector portion and a spaced first tongue second connector portion;

a first ring member coupled to the second flexible front band portion;

wherein the first elongated tongue is adapted to extend through the first ring member and loop back onto itself; and wherein the first tongue first connector portion is adapted to lockingly engage the first tongue second connector portion.

2. The brassiere of claim 1 wherein the first tongue connector portion is an array of hooks and the second tongue connector portion is an array of loops adapted to lockingly engage the array of hooks.

3. The brassiere of claim 1 wherein the first flexible shoulder strap includes a first front strap portion extending from the first flexible front band and having a first front strap connecting end with a first front strap connector portion and a first rear strap portion extending from the backstrap portion and having a first rear strap connecting end with a first rear strap connector portion adapted to lockingly engage the first front strap connector portion and wherein the second flexible shoulder strap includes a second front strap portion extending from the second flexible front band and having a second front strap connecting end with a second front strap connector portion and a second rear strap portion extending from the backstrap portion and having a second rear strap connecting end with a second rear strap connector portion adapted to lockingly engage the second front strap connector portion.

4. The brassiere of claim 1 wherein the first ring member is a D-ring.

5. The brassiere of claim 1 further comprising:

a second elongated tongue member tongue connected to the first flexible front band portion and having a second tongue first connector portion and a spaced second tongue second connector portion;

a second ring member coupled to the second flexible front band portion;

wherein the second elongated tongue is adapted to extend through the second ring member and lockingly engage itself; and wherein the second tongue first connector portion is adapted to lockingly engage the second tongue second connector portion.

6. A method of a wearer single-handedly putting on a brassiere, comprising the steps of:

a) providing a brassiere having at least one cup, a first brassiere end portion having an elongated tongue extending therefrom and including a first tongue connector portion formed on the tongue and a second tongue connector portion adapted to lockingly engage the first tongue connector portion formed on the tongue, and a second brassiere end having a connecting ring operationally coupled thereto;

b) encircling the brassiere around a wearer's torso, wherein the wearer has at least one breast;

c) inserting at the least one breast into the at least one cup;

d) guiding the tongue through the ring;

e) pulling the tongue over the loop and towards the first end portion until the brassiere is snug around the wearer's torso; and f) lockingly engaging the first tongue connector portion to the second tongue connector portion.

* * * * *

UNITED STATES PATENT AND TRADEMARK OFFICE

CERTIFICATE OF CORRECTION

PATENT NO. : 6,319,091 B1
DATED : November 20, 2001
INVENTOR(S) : Lynn Elizabeth Kilbride et al.

It is certified that error appears in the above-identified patent and that said Letters Patent is hereby corrected as shown below:

In Drawing Sheets 1-6, please delete informal FIGs. 1A through 7B and insert in lieu thereof the attached formal FIGs. 1A through 7B.

Signed and Sealed this

Twenty-sixth Day of March, 2002

*Attest:*

*Attesting Officer*

JAMES E. ROGAN
*Director of the United States Patent and Trademark Office*

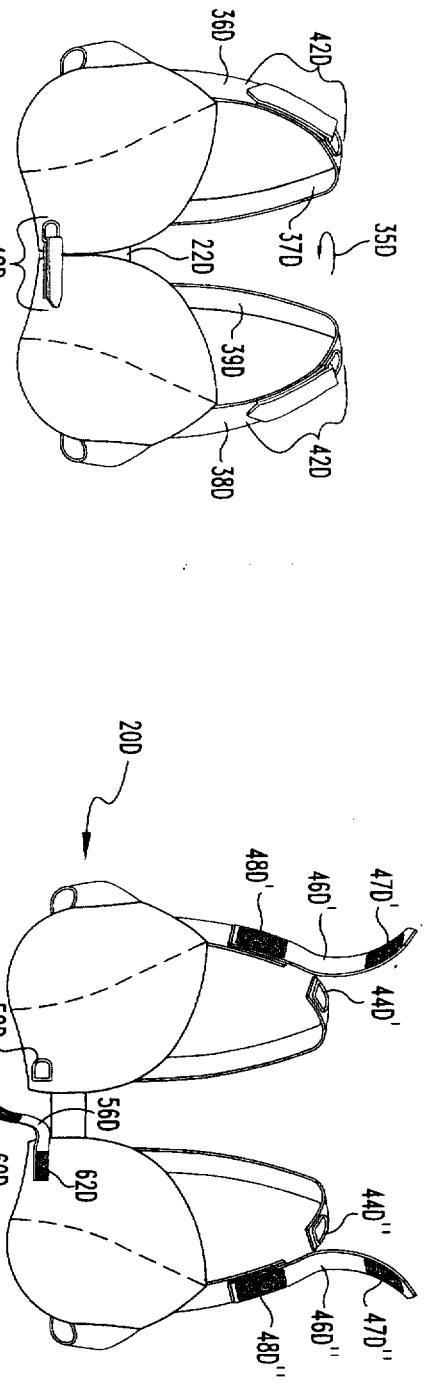
Fig 6A
Fig 6B
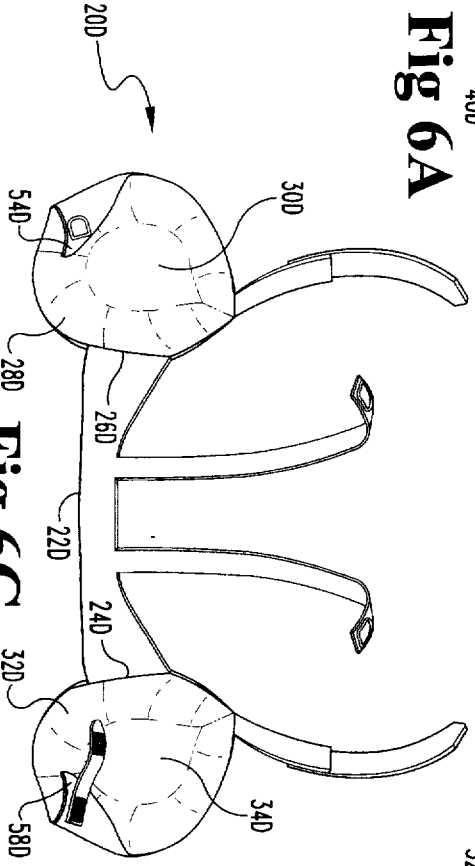
Fig 6C